US010847885B2

(12) United States Patent
Sharawi et al.

(10) Patent No.: US 10,847,885 B2
(45) Date of Patent: Nov. 24, 2020

(54) MINIATURIZED UWB BI-PLANAR YAGI-BASED MIMO ANTENNA SYSTEM

(71) Applicant: King Fahd University of Petroleum and Minerals, Dhahran (SA)

(72) Inventors: Mohammad S. Sharawi, Dhahran (SA); Syed Shahan Jehangir, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 16/000,333

(22) Filed: Jun. 5, 2018

(65) Prior Publication Data

US 2019/0372226 A1 Dec. 5, 2019

(51) Int. Cl.

| | |
|---|---|
| ***H01Q 5/49*** | (2015.01) |
| ***H01Q 1/24*** | (2006.01) |
| ***H01Q 7/00*** | (2006.01) |
| ***H01Q 19/30*** | (2006.01) |

(52) U.S. Cl.

CPC ..... *H01Q 5/49* (2015.01); *H01Q 1/243* (2013.01); *H01Q 7/00* (2013.01); *H01Q 19/30* (2013.01)

(58) Field of Classification Search

CPC ..... H01Q 5/378; H01Q 5/40–5/49; H01Q 19/30; H01Q 7/00; H01Q 1/38; H01Q 9/04–9/28

See application file for complete search history.

(56) References Cited

U.S. PATENT DOCUMENTS

| | | | | |
|---|---|---|---|---|
| 6,842,158 | B2 * | 1/2005 | Jo | H01Q 1/243 343/700 MS |
| 8,106,833 | B2 | 1/2012 | Chou | |
| 8,228,254 | B2 | 7/2012 | Foltz et al. | |
| 9,461,356 | B2 | 10/2016 | Yurugi et al. | |
| 9,639,721 | B2 | 5/2017 | Tsirline et al. | |
| 2005/0168397 | A1 * | 8/2005 | Kaluzni | H01Q 1/38 343/795 |
| 2011/0090131 | A1 * | 4/2011 | Chen | H01Q 19/30 343/815 |

(Continued)

FOREIGN PATENT DOCUMENTS

WO 2014/036302 A1 3/2014

*Primary Examiner* — Dameon E Levi
*Assistant Examiner* — Hasan Z Islam
(74) *Attorney, Agent, or Firm* — Oblon, McClelland, Maier & Neustadt, L.L.P.

(57) ABSTRACT

A miniature antenna device includes a dielectric substrate having an upper side and an opposing lower side and at least one antenna element. The antenna element includes a first half-loop conductor strip disposed on the upper side of the substrate and a second half-loop conductor strip disposed on the lower side of the substrate. The first and second half-loop conductor strips are aligned complementarily one with the other to have a common center of curvature that is void of a ground plane. The antenna element further includes a director element disposed on the upper side of the substrate and spanning the first and second half-loop conductor strips, an input terminal disposed on the upper side of the substrate being electrically coupled to the first half-loop conductor strip, and a ground plane disposed on the lower side of the substrate being electrically coupled to the second half-loop conductor strip.

16 Claims, 8 Drawing Sheets

(56) References Cited

U.S. PATENT DOCUMENTS

| | | | | |
|---|---|---|---|---|
| 2012/0293387 | A1* | 11/2012 | Ohno | H01Q 9/285 343/818 |
| 2014/0197832 | A1* | 7/2014 | Driesel | H01Q 7/005 324/307 |
| 2016/0006116 | A1* | 1/2016 | Sharawi | H01Q 21/0006 343/853 |

* cited by examiner

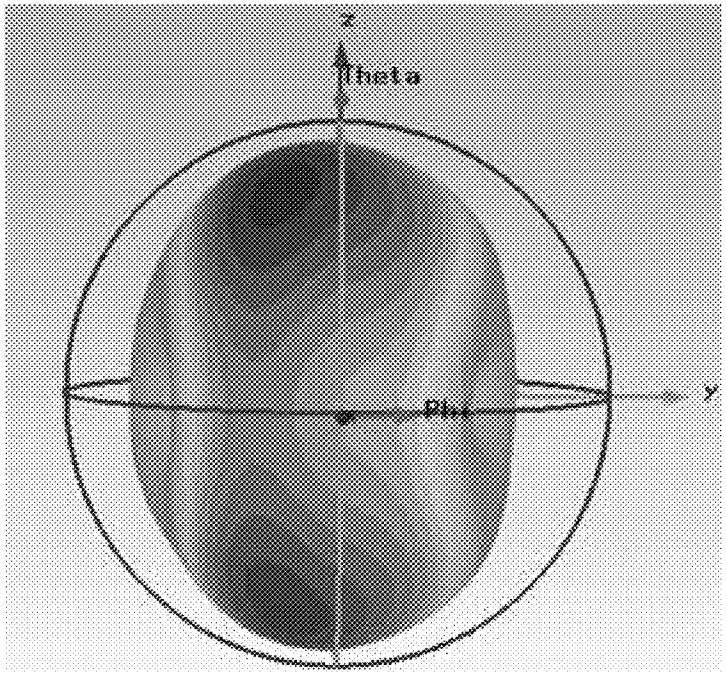
FIG. 6B
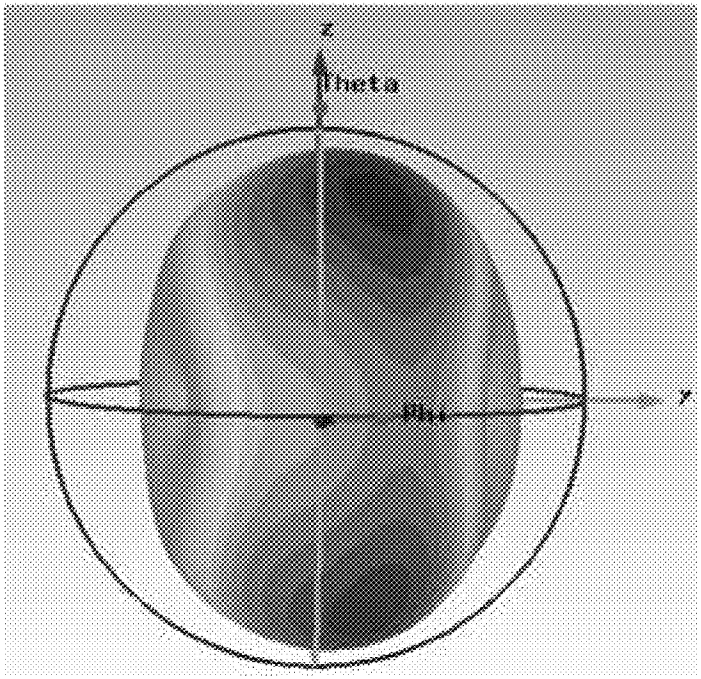
FIG. 6A
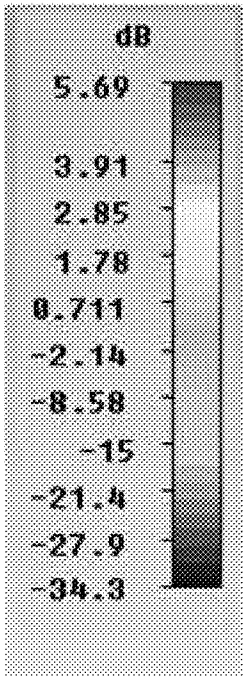

MINIATURIZED UWB BI-PLANAR YAGI-BASED MIMO ANTENNA SYSTEM

BACKGROUND

Field of the Invention

The present disclosure is related to an apparatus for a compact ultra-wideband (UWB) Yagi-based MIMO antenna.

Description of the Related Art

Wireless communication systems have evolved very rapidly in past few decades. The demand for high data rates or channel capacity is significantly increasing since high data transmission rates are essential for fast wireless internet connectivity that includes internet browsing, video streaming, online gaming, and on-road navigation assistance. Channel capacity and/or data transmission rate increases with an increase in the number of independent channels between the transmitter and the receiver in a rich multipath environment. Channel capacity can be increased by increasing the frequency bandwidth or power levels, but these two parameters are restricted by regulations in order to avoid interference with other wireless standards as well as to reduce costs. However, multiple-input-multiple-output (MIMO) technology is based on using multiple antennas at the transmitter as well as at the receiver side which can linearly increase the channel capacity and can overcome the limitations of bandwidth and power level.

Compact wideband multiple-input-multiple-output (MIMO) antenna systems are relevant to the current 4G, as well as upcoming 5G, wireless systems due to their wide range of applications. The use of multiple antennas, for example printed wideband MIMO antenna systems, can directly increase the data rates (channel capacity) and can provide better coverage within the limitations of the transmission bandwidth and power levels. Moreover, using multiple antennas covers multiple bands of different standards simultaneously without the need of extra hardware for frequency switching. To increase the number of antennas at the transmitter side, i.e. a base station, is not difficult due to the availability of enough space. Challenges arise when attempting to increase the number of antennas inside compact user terminals as this will increase the mutual coupling between the adjacent antenna elements and hence will degrade the MIMO performance in terms of diversity, spectral efficiency, gain, and bandwidth. These antennas need to be carefully designed with low coupling (high isolation) through the shared ground plane as well as in their adjacent radiated fields. Directional antennas can provide very low far field correlation between the antenna elements via directional radiation patterns, and thus, more isolated channels can be obtained for better diversity performance. Therefore, directional antennas in MIMO antenna systems based on Yagi-Uda configurations are of high interest for use in current and future wireless communication technology due to their directional patterns which can provide low field correlations in WLAN access point applications.

Printed Yagi-Uda antennas are well-known for their directional radiation patterns with high front-to-back ratio (FBR), gain, directivity, and low cross polarization. It has a moderate bandwidth which can be increased using various feeding mechanisms and balun structures. Aside from several advantages, these antennas are larger in size due to the presence of the large ground plane or reflector element which is used to achieve high FBR using a dipole excitation. Using such antennas in a MIMO configuration can increase its size, and hence, such antenna systems are difficult to use in compact handheld user devices due to the size constraints. Using a loop antenna as the driven element for QuasiYagi antennas instead of a dipole offers several advantages such as wide bandwidth, high FBR, high directivity, and high efficiency. However, this again increases the overall size of the antenna because of the high resonating modes of the loop element like 1.5 $\lambda g$ (where $\lambda g$ is the guided wavelength) and 2 $\lambda g$.

The present disclosure addresses the limitations of conventional antenna systems by utilizing a compact ultra-wideband (UWB) Yagi based MIMO antenna system with loop excitation that may function with a combination of antenna miniaturization and bandwidth enhancement. A Yagi based MIMO antenna system with high directional radiation and high front-to-back ratio (FBR) is described herein.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

According to one or more embodiments of the disclosed subject matter, a miniature antenna device includes a dielectric substrate having an upper side and an opposing lower side and at least one antenna element. The antenna element includes a first half-loop conductor strip disposed on the upper side of the substrate and a second half-loop conductor strip disposed on the lower side of the substrate. The first and second half-loop conductor strips are aligned complementarily one with the other to have a common center of curvature that is void of a ground plane.

In another embodiment of the invention, the antenna element further includes a director element disposed on the upper side of the substrate and spanning the first and second half-loop conductor strips.

In another embodiment of the invention, the antenna element includes an input terminal disposed on the upper side of the substrate being electrically coupled to the first half-loop conductor strip, and a ground plane disposed on the lower side of the substrate being electrically coupled to the second half-loop conductor strip, wherein the ground plane is disposed on a side of the second half-loop conductor strip opposite the director element.

In another embodiment of the invention, the number of antenna elements disposed on the substrate is greater than one.

In another embodiment of the invention, the curvatures of the first and second half-loop conductor strips alternate in direction in pairs of the antenna elements.

In another embodiment of the invention, the antenna element is configured to operate at a frequency of 5.8 GHz.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 6A is a schematic of the simulated 3D gain patterns obtained from Computer Simulation Technology at 5.8 GHz for the first antenna of the MIMO antenna system according to one or more aspects of the disclosed subject matter;

FIG. 6B is a schematic of the simulated 3D gain patterns obtained from Computer Simulation Technology at 5.8 GHz for the second antenna of the MIMO antenna system according to one or more aspects of the disclosed subject matter;

DETAILED DESCRIPTION

Figure 1:
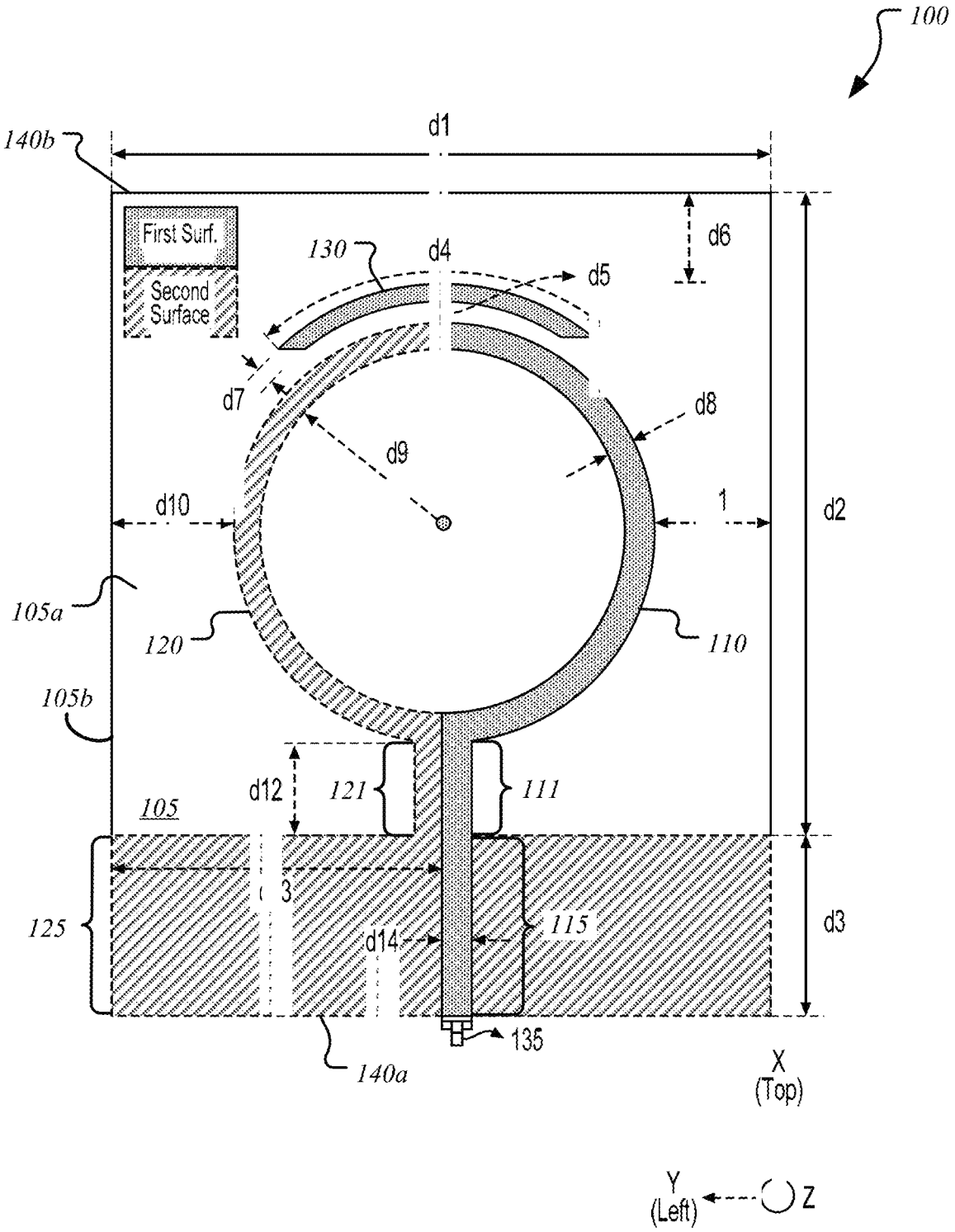
FIG. 1 is a schematic of a single bi-planar Yagi-like antenna device according to one or more aspects of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Designing a loop-excited Yagi MIMO antenna system with a small ground plane to achieve compactness can be challenging since a small ground plane can yield a non-desired omni-directional radiation pattern having a FBR of 1 to 2 dB. Therefore, a novel antenna miniaturization technique is needed which reduces the overall size of the antenna system while simultaneously providing a directional radiation pattern with high FBR.

A compact ultra-wideband (UWB) loop excited Yagi based MIMO antenna system is disclosed. The miniaturization technique includes implementation of half of the loop element on each side of the substrate which can also reduce the overall size of the antenna by approximately 45% such that it can be fabricated on a substrate with approximate dimensions of, for example, 40 mm by 50 mm. Such an implementation allows reduction of the ground plane size or the reflector element that reduces the overall size of the antenna system without affecting the front-to-back ratio (FBR) performance. Moreover, the proposed technique excites the even and odd modes which can further increase the bandwidth to 45% with a simple feeding mechanism as compared to complex balun structures or waveguide feeding.

The disclosed MIMO design can use bi-planar geometry via loop excitation. A high FBR is achieved using a small ground plane with loop excitation unlike using a large ground plane with dipole excitation for back-lobe minimization. Both miniaturization and bandwidth enhancement are achieved without compromising other performance metrics such as gain, FBR, and efficiency that are usually affected using any miniaturization technique.

As illustrated in FIG. 1 according to one or more aspects of the disclosed subject matter, the geometry of a single bi-planar Yagi-like loop antenna device 100 (herein referred to as single antenna device 100) is shown. The single antenna device 100 includes a substrate 105, a first half-loop antenna 110, a second half-loop antenna 120, and a parasitic director 130.

The substrate 105 can be a dielectric substrate designed to enhance overall efficiency and achieve a predetermined gain and bandwidth. For example, the substrate 105 can be a RO4350 substrate by Rogers Corporation having a thickness of 0.76 mm, dielectric constant ($\varepsilon_r$) of 3.48, and loss tangent of 0.004. The substrate 105 can include a first surface 105*a* and a second surface 105*b*, wherein the first surface 105*a* and second surface 105*b* are on opposing sides of the substrate 105. For example, the first surface 105*a* can be an upper side and the second surface 105*b* can be an opposing lower side. The substrate 105 can include a first substrate end 140*a* and a second substrate end 140*b*, wherein the first substrate end 140*a* and the second substrate end 140*b* are on opposing ends of the substrate 105. The substrate 105 can have an overall width described by a dimension d1 oriented along a y-axis and an overall length described by dimensions d2 and d3 oriented along an x-axis. For example, the substrate 105 can have a width of 35 to 45 mm, or 40 mm and a length of 45 to 55 mm, or 50 mm, wherein the dimension d2 can be 35 to 45 mm, or 39 mm, and dimension d3 can be 10 to 15 mm, or 11 mm. Non-limiting examples of materials for the substrate 105 include at least one of woven glass reinforced hydrocarbon, woven glass reinforced ceramics, foam, benzocyclobutane, epoxy, nylon, duroid and RT-duroid by the Roger Corporation, and FR-4 materials as designated by the National Electrical Manufacturers Association (NEMA).

In one embodiment, the first half-loop antenna 110 can be fabricated on the first surface 105*a*. For example, it can be printed. The first half-loop antenna 110 can be a half-loop, semi-circular shape comprising a conductive material and be oriented such that the apex of the semi-circle is pointed in the y-axis direction to the right (as shown). The first half-loop antenna 110 further includes a first straight segment 111 electrically coupled to the bottom of the semi-circular shape, wherein the bottom refers to the end of the semi-circular shape disposed opposite of the second substrate end 140*b*. The first straight segment 111 can be oriented parallel to the x-axis, have a length described by dimension d12, and a thickness described by dimension d14. The semi-circular shape of first half-loop antenna 110 can have an inner radius described by dimension d9 and a thickness described by dimension d8. For example, the thickness of the first half-loop antenna 110 can be, for example, 1.7 to 1.9 mm, or 1.8 mm. The length of the first straight segment 111 can be, for example, 5.5 to 6 mm, or 5.7 mm, or 5.72 mm, and the thickness can be, for example, 1.7 to 1.75 mm, or 1.72 mm, or 1.724 mm. Electrically coupled to the first straight segment 111 of the first half-loop antenna 110 can be a microstrip line 115 having length d3. For example, the length of the microstrip line 115 can be 10 to 12 mm, or 11 mm. The microstrip line 115 can be electrically coupled to and fed via a coaxial connector 135, for example an SMA connector, disposed at the first substrate end 140*a*. Together, the length, as measured along the x-axis, of the first half-loop antenna 110, first straight segment 111, and microstrip line 115 can be designed to match a predetermined guided wavelength ($\lambda g$). The additive length, as measured along the x-axis, of the first half-loop antenna 110, first straight segment 111, and microstrip line 115 can be approximately 1.6 $\lambda g$, for example 40 to 45 mm, or 42 mm, or 42.3 mm for a frequency at 5.8 GHz.

The second half-loop antenna 120 can be fabricated on the second surface 105*b*. For example, it can be printed. The second half-loop antenna 120 can be fabricated to similar specifications as the first half-loop antenna 110. The second half-loop antenna 120 can be a half-loop, semi-circular shape comprising a conductive material having a similar inner radius and thickness as the first half-loop antenna 110, and be oriented such that the apex of the semi-circle is pointed in the y-axis direction to the left (when viewed from the same perspective as previously oriented to describe the first half-loop antenna 110, as shown). That is, the apex of the semi-circles point in opposite directions in the y-axis direction. The second half-loop antenna 120 can include a second straight segment 121 electrically coupled to the bottom of the semi-circular shape. In contrast to the first half-loop antenna 110 and first straight segment 111, the second straight segment 121 can be electrically coupled to a truncated ground plane 125 having a rectangular shape. The truncated ground plane 125 can occupy the width of the substrate 105 and extend distance d3 from the first substrate end 140*a*. The width of the truncated ground plane 125 can be, for example, 38 to 42 mm, or 40 mm. The length of the truncated ground plane 125 can be, for example, 10 to 12 mm, or 11 mm. The truncated ground plane 125 can be electrically coupled to the coaxial connector 135. The truncated ground plane 125 can be electrically coupled to the outer conductors of the coaxial connector 135 and the microstrip line 115 can be electrically coupled to the center conductor of the coaxial connector 135. The truncated ground plane 125 can be configured to reflect electromagnetic radiation from the other elements in the single antenna device 100.

The first and second half-loop antennas 110, 120 can be positioned centrally on the substrate 105 such that the apex of both semicircles are distanced from edges of the substrate 105 by dimensions d10 and d11. For example, they can be distanced from the edges of the substrate 105 by 7 to 8 mm, or 7.2 mm. Together, the overlaid positions of the first and second half-loop antennas 110, 120 can form a shape sharing a common center of curvature, for example a substantially circular shape (as shown). The first straight segment 111 and microstrip line 115 can be distanced from the left edge of the substrate 105 by dimension d13. For example, they can be distanced from the edge by 20 mm.

The parasitic director 130 can be fabricated on the first surface 105*a*. For example, the parasitic director 130 can be printed. The parasitic director 130 can be shaped to adopt the same curvature as the half-loop antennas 110, 120. The parasitic director 130 can have a length described by dimension d4 and a thickness described by dimension d7. The length of the parasitic director 130 can be, for example, 20 to 21 mm, or 20.8 mm, and the thickness can be, for example, 1 to 1.5 mm, or 1.3 mm. The parasitic director 130 can be disposed between the second substrate end 140*b* and the half-loop antennas 110, 120. The parasitic director 130 can be separated from the half-loop antennas 110, 120 by dimension d5. The separation can be, for example, 1 to 1.5 mm, or 1.1 mm. The parasitic director can be separated from the second substrate end 140*b* by dimension d6. The separation can be, for example, 5 to 6 mm, or 5.6 mm, or 5.68 mm.

Non-limiting examples of materials for the first half-loop antenna 110, second half-loop antenna 120, truncated ground plane 125, and parasitic director 130 can include at least one of copper, silver, gold, and other metals and metal alloys.

The parasitic director 130 can be designed to modify the radiation pattern of the electromagnetic waves emitted by the half-loop antennas 110, 120 and direct them in a directional beam. When a typical driven element on an antenna radiates, a potential difference is induced in the parasitic element (here, the parasitic director 130) and a leading current flows in it. The parasitic director 130 re-radiates and again adds to or subtracts from the radiation at the driven element, increasing or decreasing the signal going to the receiver, depending on the direction in which the antenna is pointing relative to the transmitter. This can serve to increase the FBR performance and gain wherein a maximum current density is obtained in the end-fire direction along the x-axis.

In one embodiment, the single antenna device 100 is constructed on a RO4350 substrate having a thickness of 0.76 mm, dielectric constant ($\varepsilon_r$) of 3.48, and loss tangent of 0.004. With a frequency of 5.8 GHz, the dimensions of the single antenna device 100 are d1=40 mm, d2=39 mm, d3=11 mm, d4=20.8 mm, d5=1.1 mm, d6=5.68 mm, d7=1.3 mm, d8=1.8 mm, d9=11 mm, d10=d11=7.2 mm, d12=5.72 mm, d13=20 mm, and d14=1.724 mm. The truncated ground plane 125 is connected to electrical ground, such as when the outer conductors of coaxial connector 135 is grounded. The microstrip line 115 is connected to the center conductor of the coaxial connector 135.

In another embodiment, the single antenna device 100 can be fabricated without the truncated ground plane 125 and the second straight segment 121 is electrically coupled to the outer conductors of the coaxial connector 135. That is, the single antenna device 100 can be void of the truncated ground plane 125.

In an alternative embodiment, the single antenna device 100 can be fabricated without the truncated ground plane 125, the microstrip line 115, and the second straight segment 121. The first half-loop antenna 110 and the second half-loop antenna 120 can be electrically coupled to the coaxial connector 135. For example, the first half-loop antenna 110 can be electrically coupled to the center conductor of the coaxial connector 135 and the second half-loop antenna 120 can be electrically coupled to the outer conductors of the coaxial connector 135.

It should be appreciated that the dimensions can be altered and scaled based on a predetermined frequency or electromagnetic wavelength to optimize the operation of the single antenna device 100 in said frequency or wavelength regime.

Figure 2:
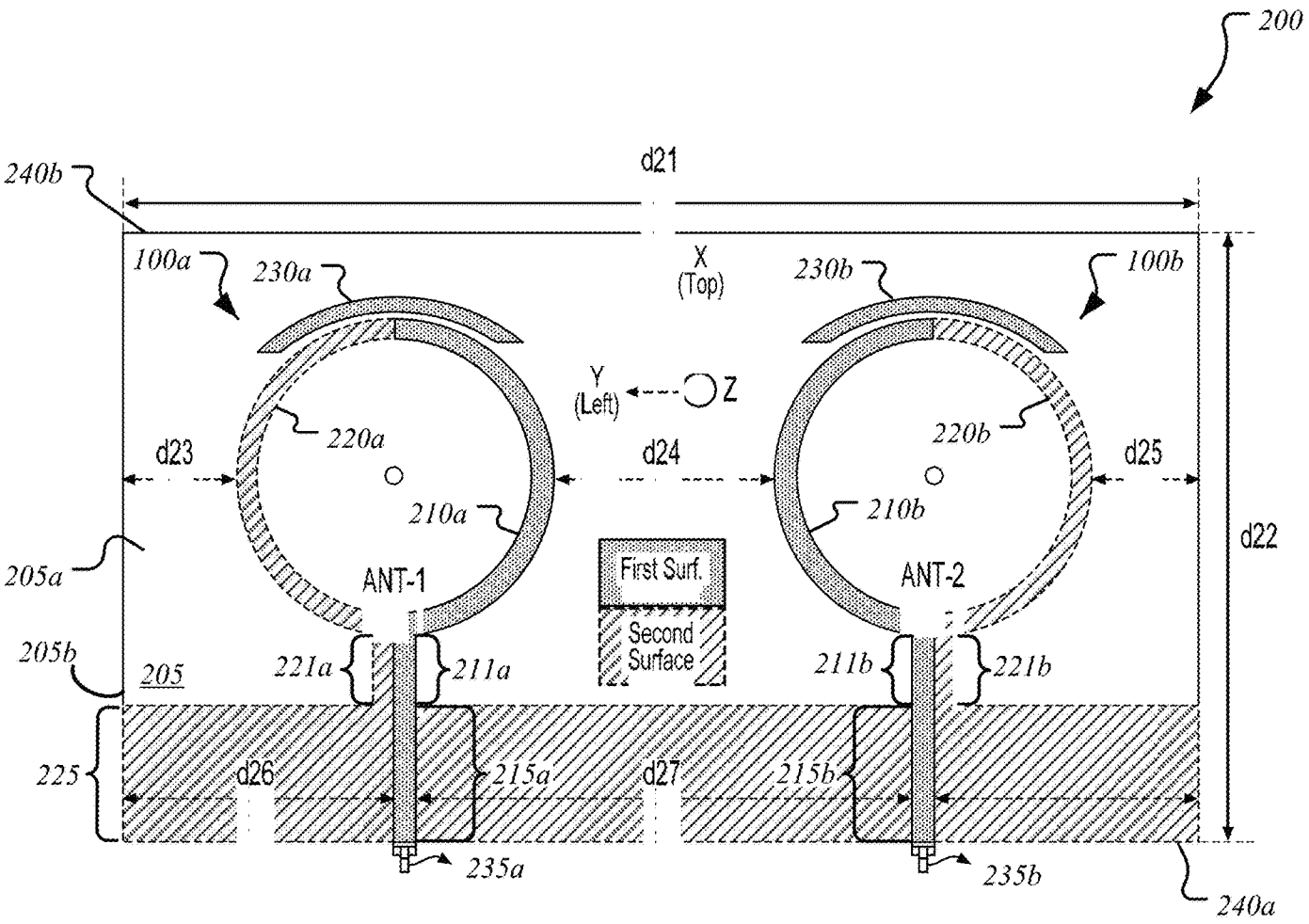
FIG. 2 is a schematic of a MIMO antenna system according to one or more aspects of the disclosed subject matter.

As illustrated in FIG. 2 according to one or more aspects of the disclosed subject matter, the geometry of a MIMO antenna system 200 is shown. In another embodiment, the MIMO antenna system 200 can include two half-loop antennas—a first single bi-planar Yagi-like antenna device 100*a* (herein referred to as first antenna 100*a*) and a second single bi-planar Yagi-like antenna device 100*b* (herein referred to as second antenna 100*b*). The first and second antennas 100*a*, 100*b* can be fabricated similar to the single antenna device 100. Each of the first and second antennas 100*a*, 100*b* can be fabricated similar to single antenna device 100 on a substrate 205 including a first surface 205*a* and a second surface 205*b*. The substrate 205 can include a first substrate end 240*a* and a second substrate end 240*b*, wherein the first substrate end 240*a* and the second substrate end 240*b* are on opposing ends of the substrate 205. The substrate 205 can have an overall width described by a dimension d21 oriented along a y-axis and an overall length described by dimensions d22 oriented along an x-axis. For example, the substrate 205 can have a width of 80 mm and a length of 50 mm. The substrate 205 can be of a similar material as the substrate 105 with similar performance properties.

The first antenna 100*a* can include: a first half-loop 210*a* of first antenna 100*a* fabricated on the first surface 205*a*, a first straight segment 211*a* of first antenna 100*a* fabricated on the first surface 205*a* and electrically coupled to the first half-loop 210*a* of first antenna 100*a*, a first microstrip line 215*a* fabricated on the first surface 205*a* and electrically coupled to the first straight segment 211*a* of first antenna 100*a*, a first parasitic director 230*a* fabricated on the first surface 205*a*, a second half-loop 220*a* of first antenna 100*a* fabricated on the second surface 205*b*, a second straight segment 221*a* of first antenna 100*a* fabricated on the second surface 205*b* and electrically coupled to the second half-loop 220*a* of first antenna 100*a*, and a truncated ground plane 225 fabricated on the second surface 205*b* and electrically coupled to the second straight segment 221*a* of first antenna 100*a*.

The first microstrip line 215*a* can be electrically coupled to and fed via a first coaxial connector 235*a*, for example an SMA connector, disposed at the first substrate end 240*a*. The first parasitic director 230*a* can be disposed between the second substrate end 240*b* and the half-loop antennas 210*a*, 220*a*.

The truncated ground plane 225 can occupy the width of the substrate 205 and extend a length from the first substrate end 240*a* similar to that of truncated ground plane 125. For example, the width of the truncated ground plane 225 can be 80 mm and the length can be 11 mm. The orientation and dimensions of the components in the first antenna 100*a* on the substrate 205 can be similar to that of the single antenna device 100. For example, the apex of the first half-loop 210*a* of the first antenna 100*a* can be pointed along the y-axis direction to the right and the apex of the second half-loop 220*a* of the first antenna 100*a* can be pointed along the y-axis direction to the left (as shown).

The second antenna 100*b* can include similar components as the single antenna device 100 and first antenna 100*a*. The second antenna 100*b* can include: a first half-loop 210*b* of second antenna 100*b* fabricated on the first surface 205*a*, a first straight segment 211*b* of second antenna 100*b* fabricated on the first surface 205*a* and electrically coupled to the first half-loop 210*b* of second antenna 100*b*, a second microstrip line 215*b* fabricated on the first surface 205*a* and electrically coupled to the first straight segment 211*b* of second antenna 100*b*, a second parasitic director 230*b* fabricated on the first surface 205*a*, a second half-loop 220*b* of second antenna 100*b* fabricated on the second surface 205*b*, a second straight segment 221*b* of second antenna 100*b* fabricated on the second surface 205*b* and electrically coupled to the second half-loop 220*b* of second antenna 100*b*, and a truncated ground plane 225 fabricated on the second surface 205*b* and electrically coupled to the second straight segment 221*b* of second antenna 100*b*.

The second microstrip line 215*b* can be electrically coupled to and fed via a second coaxial connector 235*b*, for example an SMA connector, disposed at the first substrate end 240*a*. The second parasitic director 230*a* can be disposed between the second substrate end 240*b* and the half-loop antennas 210*b*, 220*b*.

The dimensions of the components in the first antenna 100*a* on the substrate 205 can be similar to that of the single antenna device 100. The orientation of the first and second half-loops 210*b*, 220*b* of second antenna 100*b* can be mirrored to that of the single antenna device 100 and first antenna 100*a*. For example, the apex of the first half-loop 210*b* of the second antenna 100*b* can be pointed along the y-axis direction to the left and the apex of the second half-loop 220*b* of the second antenna 100*b* can be pointed along the y-axis direction to the right (as shown).

The distance between the first and second antennas 100*a*, 100*b* can be described by dimensions d24 and d27. For example, the separation between the apex of the first half-loop 210*a* of first antenna 100*a* and the apex of the first half-loop 210*b* of second antenna 100*b* can be approximately 0.5 λg, for example 14 to 15 mm, or 14.4 mm for a frequency at 5.8 GHz. The distance between the first microstrip line 215*a* and the second microstrip line 215*b* can be, for example, 36 to 37 mm, or 36.5 mm, or 36.55 mm, or 36.552 mm. The separation between the apex of the second half-loops 220*a*, 220*b* and the edges of the substrate 205 can be described by dimensions d23, d25. For example, the separation can be 7 to 7.5 mm, or 7.2 mm.

In one embodiment, the MIMO antenna system 200 is constructed on a RO4350 substrate having a thickness of 0.76 mm, dielectric constant ($\varepsilon_r$) of 3.48, and loss tangent of 0.004. With a frequency of 5.8 GHz, the dimensions of the MIMO antenna system 200 are d21=80 mm, d22=50 mm, d23=d25=7.2 mm, d24=14.4 mm, d26=20 mm, and d27=36.552 mm. Values not explicitly outlined in FIG. 2 can be described by dimensions according to the single antenna device 100 (FIG. 1). The truncated ground plane 225 is connected to electrical ground, such as when the outer conductors of coaxial connectors 235*a*, 235*b* are grounded. The microstrip lines 215*a*, 215*b* are connected to the center conductor of the coaxial connectors 235*a*, 235*b*. It can be appreciated that the antenna system can be tuned to any frequency of operation and hence other ranges of dimensions outside these stated values can be implemented depending on the application.

Figure 3:
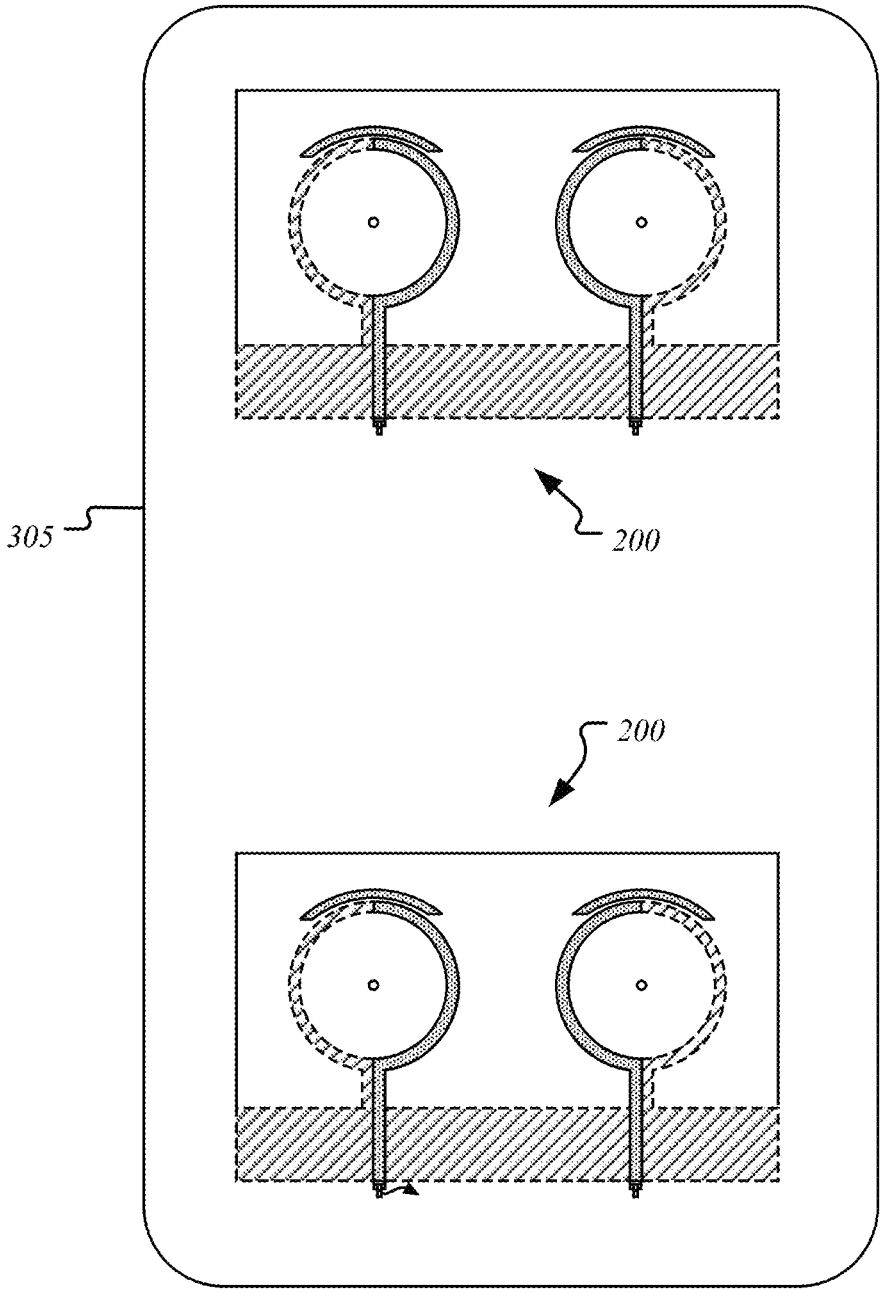
FIG. 3 is a schematic of a plurality of MIMO antenna systems in a wireless handheld device according to one or more aspects of the disclosed subject matter.
Figure 4:
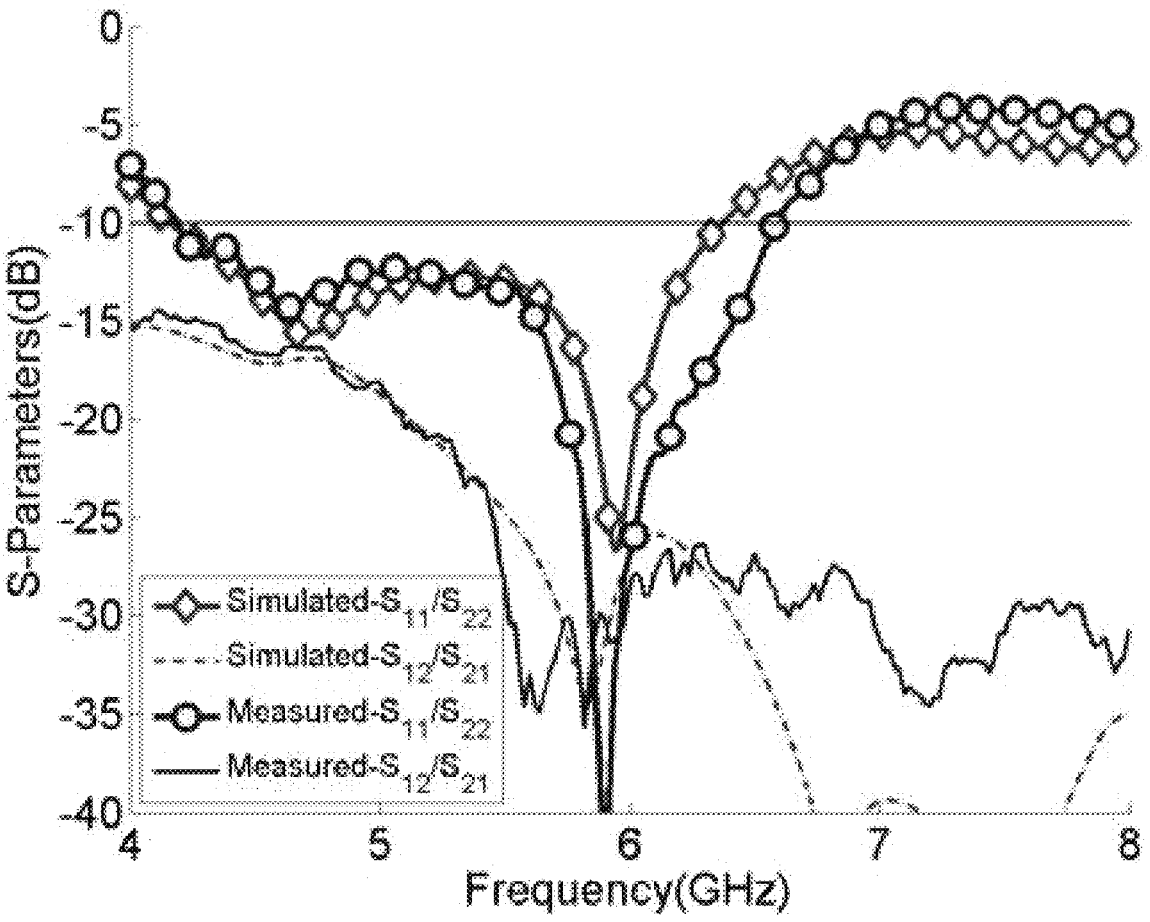
FIG. 4 is a graph of the simulated and measured S-parameter curves of the MIMO antenna system according to one or more aspects of the disclosed subject matter.

The MIMO antenna system 200 can be used in multiple devices. Each antenna includes an input and an output that are connected to the transmit and receive elements of the MIMO antenna system 200. FIG. 3 illustrates, according to one or more aspects of the disclosed subject matter, a plurality of MIMO antenna systems 200 installed inside a tablet or a wireless handheld mobile terminal 305. Using the dimensions and characteristics described above, example MIMO antenna system 200 realizes a wide measured bandwidth of 2.401 GHz, isolation of 17 dB, and an approximate size of 50 mm×80 mm×0.76 mm. For example, the bandwidth range covered can be, for example, 4.0 to 6.6 GHz, or 4.18 to 6.58 GHZ, or 4.183 to 6.584 GHz. FIG. 4, according to one or more aspects of the disclosed subject matter, shows the simulated and measured S-parameter curves of the MIMO antenna system 200. The geometry of the antenna system can be designed in, for example, Computer Simulation Technology (CST). It can be seen that the proposed antenna system has a wide measured bandwidth of 2.401 GHz (4.183-6.584 GHz) and minimum measured isolation of 17 dB within the operating band, which shows very low port coupling between the antenna elements. The simulated and measured results are in good agreement.

Figure 5A:
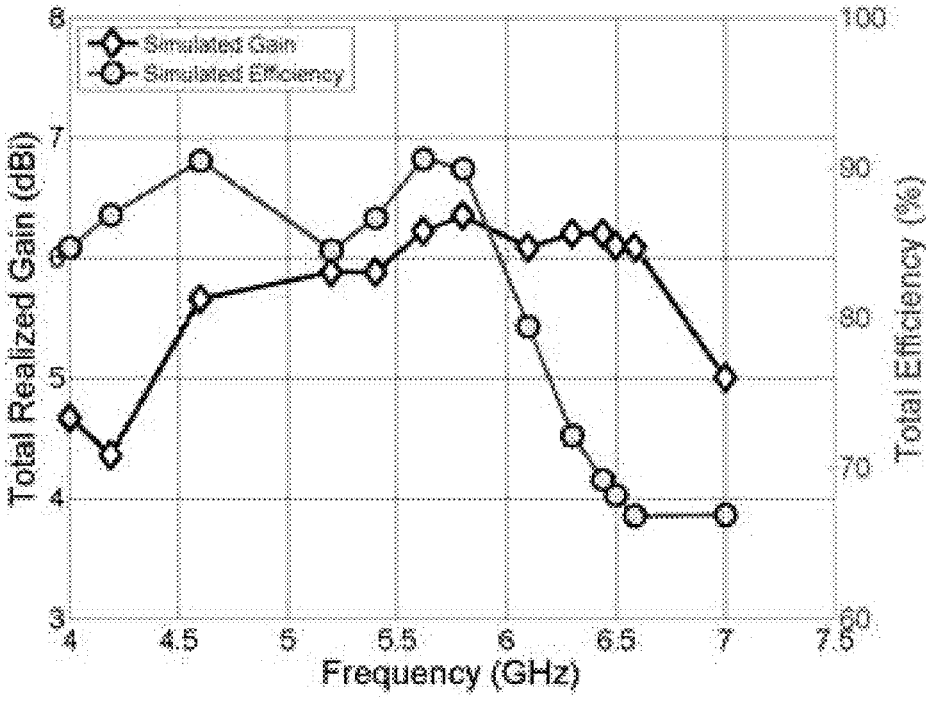
FIG. 5A is a graph of the simulated realized gain and total radiation efficiency curves of the first antenna of the MIMO antenna system according to one or more aspects of the disclosed subject matter.
Figure 5B:
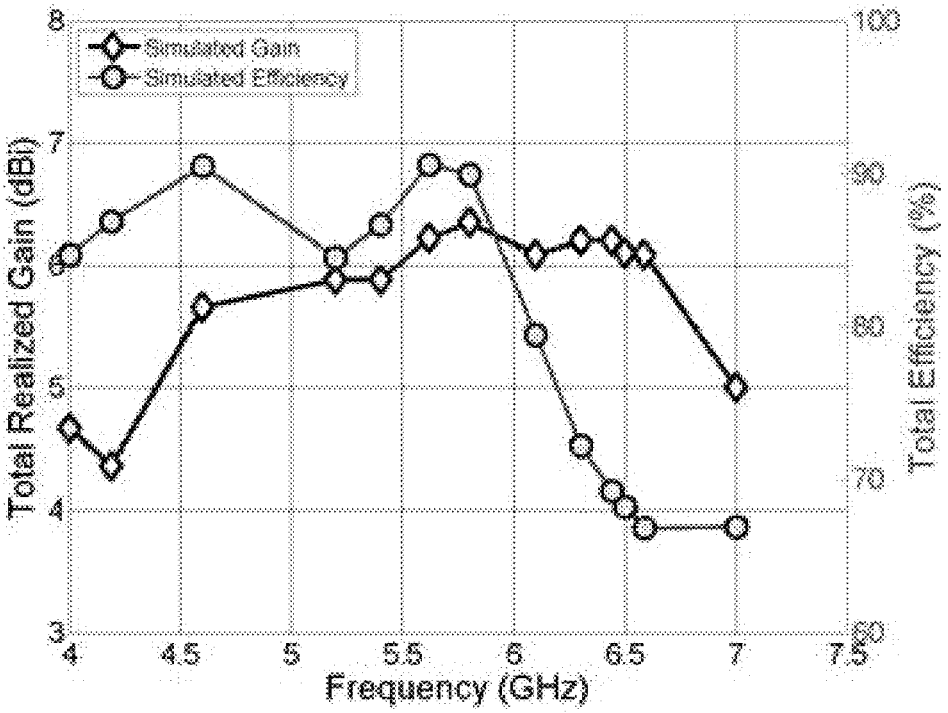
FIG. 5B is a graph of the simulated realized gain and total radiation efficiency curves of the second antenna of the MIMO antenna system according to one or more aspects of the disclosed subject matter.

FIG. 5, according to one or more aspects of the disclosed subject matter, shows the simulated realized gain and total radiation efficiency curves of the MIMO antenna system 200. FIG. 5A shows these curves for first antenna 100*a* and FIG. 5B for second antenna 100*b*. The minimum values of the gain and radiation efficiency are 5 dBi and 80%, respectively, across the band of operation.

FIGS. 6A and 6B, according to one or more aspects of the disclosed subject matter, illustrates simulated 3D gain patterns obtained from CST at 5.8 GHz for the first antenna 100*a* and second antenna 100*b*, respectively. The maximum radiations of these are tilted from each other and are pointing towards different directions which ensure very low correlation between the first and second antennas 100*a*, 100*b* in the far field.

Figure 7A:
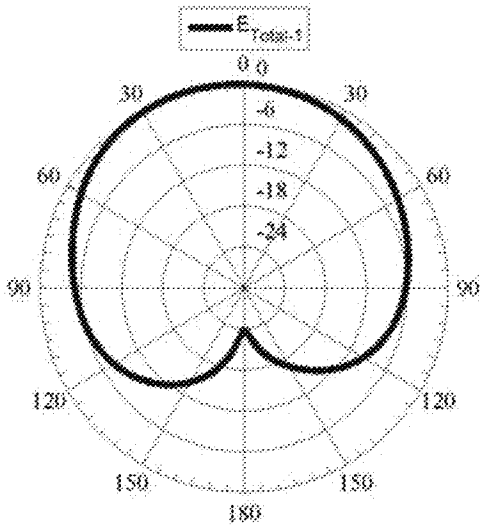
FIG. 7A is a graph of the 2D normalized radiation pattern in the X-Y plane for the first antenna of the MIMO antenna system according to one or more aspects of the disclosed subject matter.
Figure 7B:
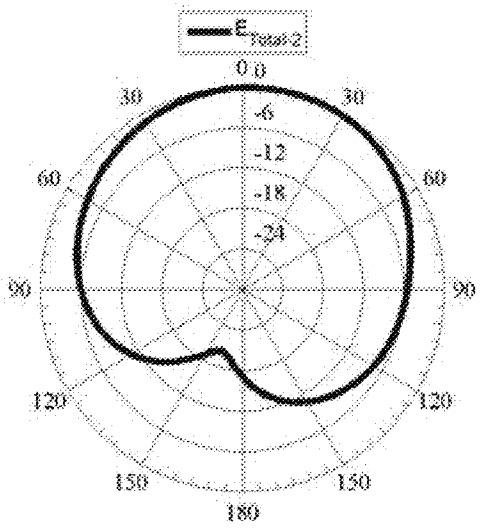
FIG. 7B is a graph of the 2D normalized radiation pattern in the X-Y plane for the second antenna of the MIMO antenna system according to one or more aspects of the disclosed subject matter.
Figure 7C:
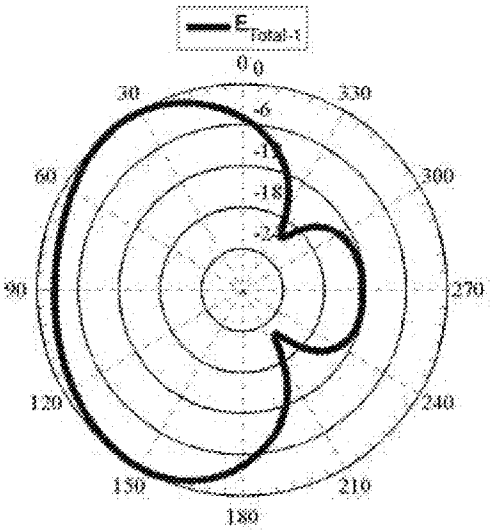
FIG. 7C is a graph of the 2D normalized radiation pattern in the X-Z plane for the first antenna of the MIMO antenna system according to one or more aspects of the disclosed subject matter.
Figure 7D:
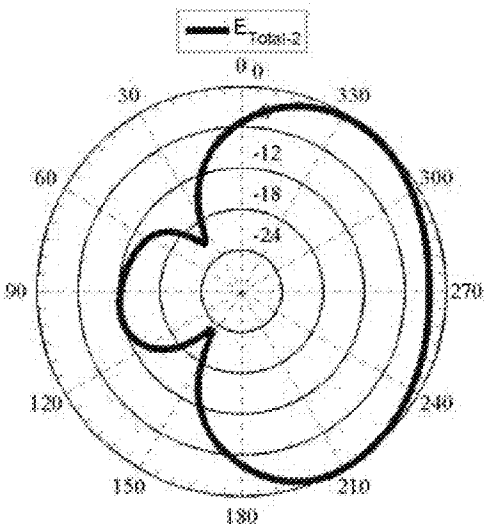
FIG. 7D is a graph of the 2D normalized radiation pattern in the X-Z plane for the second antenna of the MIMO antenna system according to one or more aspects of the disclosed subject matter.

FIG. 7A-D, according to one or more aspects of the disclosed subject matter, illustrates the 2D normalized radiation patterns in both horizontal (X-Y) and vertical (X-Z) planes computed at 5.8 GHz. FIGS. 7A and 7B illustrate these patterns in the X-Y plane obtained at θ=90° for the first and second antennas 100*a*, 100*b*, respectively, while FIGS. 7C and 7D illustrate these patterns in the X-Z plane for the first and second antennas 100*a*, 100*b*, respectively. The patterns are computed at the maximum values of phi. It can be observed that the maximum radiation of the first and second antennas 100*a*, 100*b* are pointing towards φ=20 degrees and φ=340 degrees, respectively, which shows that the patterns are tilted by 40 degrees with respect to each other. This ensures low correlation in the radiated fields as the maximum obtained envelope correlation coefficient (ECC) value was 0.0568 when computed from the radiated fields. FIGS. 7C and 7D illustrate the radiation patterns in elevation plane obtained at the maximum values of φ in order to get the FBR values. A good agreement is found between the simulation and measurement results. The minimum FBR of the MIMO antenna system 200 in both planes is 20 dB at 5.8 GHz which also ensures high directional radiation performance. The FBR was also calculated at other frequencies and it was found that the minimum value was 17 dB.

Figure 8:
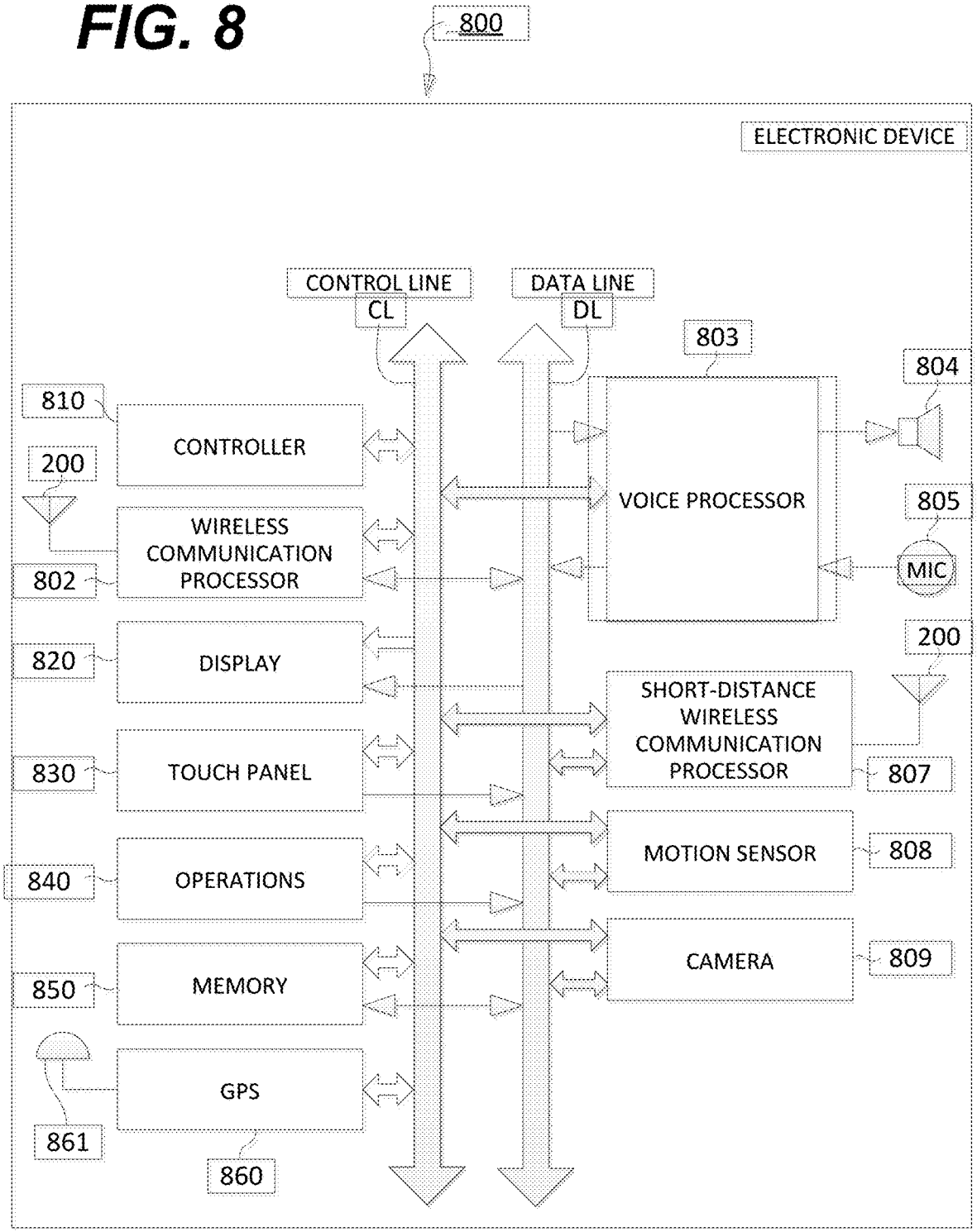
FIG. 8 is a block diagram illustrating an exemplary electronic device according to one or more aspects of the disclosed subject matter.

FIG. 8 is a block diagram illustrating an exemplary electronic device 800 used in accordance with embodiments of the present disclosure. In the embodiments, electronic device 800 can be a smartphone, a laptop, a tablet, a server, an e-reader, a camera, a navigation device, etc. Electronic device 800 could be used as one or more of the client devices 305 illustrated in FIG. 3.

The exemplary electronic device 800 of FIG. 8 includes a controller 810 and a wireless communication processor 802 connected to the MIMO antenna system 200. A speaker 804 and a microphone 805 are connected to a voice processor 803. The controller 810 can include one or more Central Processing Units (CPUs), and can control each element in the electronic device 800 to perform functions related to communication control, audio signal processing, control for the audio signal processing, still and moving image processing and control, and other kinds of signal processing. The controller 810 can perform these functions by executing instructions stored in a memory 850. Alternatively or in addition to the local storage of the memory 850, the functions can be executed using instructions stored on an external device accessed on a network or on a non-transitory computer readable medium.

The memory 850 includes but is not limited to Read Only Memory (ROM), Random Access Memory (RAM), or a memory array including a combination of volatile and non-volatile memory units. The memory 850 can be utilized as working memory by the controller 810 while executing the processes and algorithms of the present disclosure. Additionally, the memory 850 can be used for long-term storage, e.g., of image data and information related thereto.

The electronic device 800 includes a control line CL and data line DL as internal communication bus lines. Control data to/from the controller 810 can be transmitted through the control line CL. The data line DL can be used for transmission of voice data, display data, etc.

The MIMO antenna system 200 transmits/receives electromagnetic wave signals between base stations for performing radio-based communication, such as the various forms of cellular telephone communication. The wireless communication processor 802 controls the communication performed between the electronic device 800 and other external devices via the MIMO antenna system 200. For example, the wireless communication processor 802 can control communication between base stations for cellular phone communication.

The speaker 804 emits an audio signal corresponding to audio data supplied from the voice processor 803. The microphone 805 detects surrounding audio and converts the detected audio into an audio signal. The audio signal can then be output to the voice processor 803 for further processing. The voice processor 803 demodulates and/or decodes the audio data read from the memory 850 or audio data received by the wireless communication processor 802 and/or a short-distance wireless communication processor 807. Additionally, the voice processor 803 can decode audio signals obtained by the microphone 805.

The exemplary electronic device 800 can also include a display 820, a touch panel 830, an operations key 840, and the MIMO antenna system 200 connected to the short-distance communication processor 807. The display 820 can be a Liquid Crystal Display (LCD), an organic electroluminescence display panel, or another display screen technology. In addition to displaying still and moving image data, the display 820 can display operational inputs, such as numbers or icons which can be used for control of the electronic device 800. The display 820 can additionally display a GUI for a user to control aspects of the electronic device 800 and/or other devices. Further, the display 820 can display characters and images received by the electronic device 800 and/or stored in the memory 850 or accessed from an external device on a network. For example, the electronic device 800 can access a network such as the Internet and display text and/or images transmitted from a Web server.

The touch panel 830 can include a physical touch panel display screen and a touch panel driver. The touch panel 830 can include one or more touch sensors for detecting an input operation on an operation surface of the touch panel display screen. The touch panel 830 also detects a touch shape and a touch area. Used herein, the phrase "touch operation" refers to an input operation performed by touching an operation surface of the touch panel display with an instruction object, such as a finger, thumb, or stylus-type instrument. In the case where a stylus or the like is used in a touch operation, the stylus can include a conductive material at least at the tip of the stylus such that the sensors included in the touch panel 830 can detect when the stylus approaches/contacts the operation surface of the touch panel display (similar to the case in which a finger is used for the touch operation).

According to aspects of the present disclosure, the touch panel 830 can be disposed adjacent to the display 820 (e.g., laminated) or can be formed integrally with the display 820. For simplicity, the present disclosure assumes the touch panel 830 is formed integrally with the display 820 and therefore, examples discussed herein can describe touch operations being performed on the surface of the display 820 rather than the touch panel 830. However, the skilled artisan will appreciate that this is not limiting.

For simplicity, the present disclosure assumes the touch panel 830 is a capacitance-type touch panel technology. However, it should be appreciated that aspects of the present disclosure can easily be applied to other touch panel types (e.g., resistance-type touch panels) with alternate structures. According to aspects of the present disclosure, the touch panel 830 can include transparent electrode touch sensors arranged in the X-Y direction on the surface of transparent sensor glass.

The touch panel driver can be included in the touch panel 830 for control processing related to the touch panel 830, such as scanning control. For example, the touch panel driver can scan each sensor in an electrostatic capacitance transparent electrode pattern in the X-direction and Y-direction and detect the electrostatic capacitance value of each sensor to determine when a touch operation is performed. The touch panel driver can output a coordinate and corresponding electrostatic capacitance value for each sensor. The touch panel driver can also output a sensor identifier that can be mapped to a coordinate on the touch panel display screen. Additionally, the touch panel driver and touch panel sensors can detect when an instruction object, such as a finger is within a predetermined distance from an operation surface of the touch panel display screen. That is, the instruction object does not necessarily need to directly contact the operation surface of the touch panel display screen for touch sensors to detect the instruction object and perform processing described herein. Signals can be transmitted by the touch panel driver, e.g. in response to a detection of a touch operation, in response to a query from another element based on timed data exchange, etc.

The touch panel 830 and the display 820 can be surrounded by a protective casing, which can also enclose the other elements included in the electronic device 800. According to aspects of the disclosure, a position of the user's fingers on the protective casing (but not directly on the surface of the display 820) can be detected by the touch panel 830 sensors. Accordingly, the controller 810 can perform display control processing described herein based on the detected position of the user's fingers gripping the casing. For example, an element in an interface can be moved to a new location within the interface (e.g., closer to one or more of the fingers) based on the detected finger position.

Further, according to aspects of the disclosure, the controller 810 can be configured to detect which hand is holding the electronic device 800, based on the detected finger position. For example, the touch panel 830 sensors can detect a plurality of fingers on the left side of the electronic device 800 (e.g., on an edge of the display 820 or on the protective casing), and detect a single finger on the right side of the electronic device 800. In this exemplary scenario, the controller 810 can determine that the user is holding the electronic device 800 with his/her right hand because the detected grip pattern corresponds to an expected pattern when the electronic device 800 is held only with the right hand.

The operation key 840 can include one or more buttons or similar external control elements, which can generate an operation signal based on a detected input by the user. In addition to outputs from the touch panel 830, these operation signals can be supplied to the controller 810 for performing related processing and control. According to aspects of the disclosure, the processing and/or functions associated with external buttons and the like can be performed by the controller 810 in response to an input operation on the touch panel 830 display screen rather than the external button, key, etc. In this way, external buttons on the electronic device 800 can be eliminated in lieu of performing inputs via touch operations, thereby improving water-tightness.

The MIMO antenna system 200 can transmit/receive electromagnetic wave signals to/from other external apparatuses, and the short-distance wireless communication processor 807 can control the wireless communication performed between the other external apparatuses. Bluetooth, IEEE 802.11, and near-field communication (NFC) are non-limiting examples of wireless communication protocols that can be used for inter-device communication via the short-distance wireless communication processor 807.

The electronic device 800 can include a motion sensor 808. The motion sensor 808 can detect features of motion (i.e., one or more movements) of the electronic device 800. For example, the motion sensor 808 can include an accelerometer to detect acceleration, a gyroscope to detect angular velocity, a geomagnetic sensor to detect direction, a geo-location sensor to detect location, etc., or a combination thereof to detect motion of the electronic device 800. According to aspects of the disclosure, the motion sensor 808 can generate a detection signal that includes data representing the detected motion. For example, the motion sensor 808 can determine a number of distinct movements in a motion (e.g., from start of the series of movements to the stop, within a predetermined time interval, etc.), a number of physical shocks on the electronic device 800 (e.g., a jarring, hitting, etc., of the electronic device 800), a speed and/or acceleration of the motion (instantaneous and/or temporal), or other motion features. The detected motion features can be included in the generated detection signal. The detection signal can be transmitted, e.g., to the controller 810, whereby further processing can be performed based on data included in the detection signal. The motion sensor 808 can work in conjunction with a Global Positioning System (GPS) 860. The GPS 860 detects the present position of the electronic device 800. The information of the present position detected by the GPS 860 is transmitted to the controller 810. An antenna 861 is connected to the GPS 860 for receiving and transmitting signals to and from a GPS satellite.

Electronic device 800 can include a camera 809, which includes a lens and shutter for capturing photographs of the surroundings around the electronic device 800. In an embodiment, the camera 809 captures surroundings of an opposite side of the electronic device 800 from the user. The images of the captured photographs can be displayed on the display panel 820. A memory saves the captured photographs. The memory can reside within the camera 809 or it can be part of the memory 850. The camera 809 can be a separate feature attached to the electronic device 800 or it can be a built-in camera feature.

The advantages of the disclosed MIMO antenna system 200 are summarized again as follows: at 5.8 GHz the MIMO antenna system 200 has high directional radiation characteristics with a measured FBR of 18 dB or more, a wide measured bandwidth of 2.401 GHz ranging from 4.183 to 6.584 GHz, gain of 5 dBi or more, directivity of 6.6 dB, isolation of 17 dB or more, envelope correlation coefficient value of 0.0568 or less, efficiency of 80% or more, and size reduction of 45% or more.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. An antenna device comprising:

a dielectric substrate having an upper side and an opposing lower side;

at least one antenna element comprising:

a first half-loop conductor strip disposed on the upper side of the substrate;

a second half-loop conductor strip disposed on the lower side of the substrate, the first and second half-loop conductor strips being aligned complementarily one with the other to have a common center of curvature that is void of a ground plane.

2. The antenna of claim 1, wherein the antenna element further comprises a director element disposed on the upper side of the substrate and spanning the first and second half-loop conductor strips.

3. The antenna of claim 2, wherein the antenna element further comprises:

an input terminal disposed on the upper side of the substrate and electrically coupled to the first half-loop conductor strip; and a ground plane disposed on the lower side of the substrate and electrically coupled to the second half-loop conductor strip, wherein the ground plane is disposed on a side of the second half-loop conductor strip opposite the director element.

4. The antenna of claim 1, wherein the number of antenna elements disposed on the substrate is greater than one.

5. The antenna of claim 4, wherein the curvatures of the first and second half-loop conductor strips alternate in direction in pairs of the antenna elements.

6. The antenna of claim 1, wherein the antenna element is configured to operate at a frequency of 5.8 GHz.

7. The antenna of claim 1, wherein a material of the antenna element includes at least one of copper, silver, gold, conductive metals, and metal alloys.

8. The antenna of claim 1, wherein each antenna element is no greater than 2000 $mm^2$ in area.

9. An apparatus comprising:

a miniature antenna device comprising:

a dielectric substrate having an upper side and an opposing lower side;

at least one antenna element, each antenna element comprising:

a first half-loop conductor strip disposed on the upper side of the substrate;

a second half-loop conductor strip disposed on the lower side of the substrate, the upper and lower half-loop conductor strips being aligned complementarily one with the other to have a common center of curvature that is void of a ground plane.

a radio communicatively coupled to the antenna device on which to conduct communications.

10. The apparatus of claim 9, wherein the antenna element further comprises a director element disposed on the upper side of the substrate and spanning the first and second half-loop conductor strips.

11. The apparatus of claim 10, wherein the antenna element further comprises:

an input terminal disposed on the upper side of the substrate and electrically coupled to the first half-loop conductor strip; and a ground plane disposed on the lower side of the substrate and electrically coupled to the second half-loop conductor strip, wherein the ground plane is disposed on a side of the second half-loop conductor strip opposite the director element.

12. The apparatus of claim 9, wherein the curvatures of the first and second half-loop conductor strips alternate in direction in pairs of the antenna elements.

13. The apparatus of claim 9, wherein the antenna element is configured to operate at a frequency of 5.8 GHz.

14. The apparatus of claim 9, wherein a material of the antenna element includes at least one of copper, silver, gold, conductive metals, and metal alloys.

15. The apparatus of claim 9, wherein each antenna element is no greater than 2000 $mm^2$ in area.

16. The apparatus of claim 9, wherein the radio is electrically connected to smartphone circuitry.

* * * * *